United States Patent [19]

Fee

[11] Patent Number: 4,715,534

[45] Date of Patent: Dec. 29, 1987

[54] RAIL FASTENING ASSEMBLIES

[75] Inventor: Graham M. Fee, Geneva, Ohio

[73] Assignee: Chemetron Railway Products, Inc., Chicago, Ill.

[21] Appl. No.: 858,094

[22] Filed: Apr. 30, 1986

Related U.S. Application Data

[63] Continuation of Ser. No. 240,411, Mar. 4, 1981, abandoned, which is a continuation of Ser. No. 930,232, Aug. 2, 1978, abandoned.

[51] Int. Cl.[4] ..... E01B 9/30

[52] U.S. Cl. ..... 238/349; 238/338

[58] Field of Search ..... 238/310, 315, 338, 343, 238/349, 351

[56] References Cited

U.S. PATENT DOCUMENTS

| | | | |
|---|---|---|---|
| 2,954,169 | 9/1960 | Rigby | 238/349 |
| 3,724,754 | 4/1973 | Molyneux et al. | 238/349 |
| 3,887,128 | 6/1975 | Ruble | 238/349 |
| 4,074,860 | 2/1978 | Rex | 238/349 |
| 4,190,200 | 2/1980 | Morrow | 238/349 |

FOREIGN PATENT DOCUMENTS

| | | | |
|---|---|---|---|
| 2345647 | 3/1974 | Fed. Rep. of Germany | 238/351 |
| 2741238 | 4/1978 | Fed. Rep. of Germany | 238/349 |
| 869385 | 5/1961 | United Kingdom | 238/349 |
| 1044884 | 10/1966 | United Kingdom | 238/349 |
| 1154497 | 6/1969 | United Kingdom | 238/349 |
| 1305871 | 2/1973 | United Kingdom | 238/349 |
| 1496390 | 12/1977 | United Kingdom | 238/349 |

*Primary Examiner*—Randolph A. Reese

*Attorney, Agent, or Firm*—Welsh & Katz, Ltd.

[57] ABSTRACT

A drive-on rail fastening assembly for securing a railway rail to an anchoring support therefor is comprised of a generally S-shaped torsional spring rail clip and a chair adapted to cooperate therewith. The rail clip includes a central leg, a tie anchor portion and a rail bearing portion comprising a pair of loops on opposite sides and extending from opposite ends thereof, each of the loops including an arcuate and a terminal leg. The chair is adapted to have the rail clip driven thereon in seating engagement therewith.

19 Claims, 12 Drawing Figures

RAIL FASTENING ASSEMBLIES

This application is a continuation of application Ser. No. 240,411, filed Mar. 4, 1981, now abandoned, which is a continuation of Ser. No. 930,232, filed Aug. 2, 1978, abandoned.

The present invention relates, generally, to assemblies for securing a rail to an anchoring support or crosstie therefor. More specifically, the patent invention relates to a simplified drive-on rail fastening assembly including a torsional spring rail clip having a generally S-shaped geometrical configuration, and a cooperating chair designed to engage a tie anchor portion of the clip and restrain a rail bearing portion thereof in proximate engagement with the base flange of a railway rail.

Reference is made to copending application entitled, Improvements in Rail Fastening Assemblies, filed on Aug. 14, 1978, Ser. No. 933,630, now abandoned, which was continued in U.S. Ser. No. 228,804, filed on Jan. 27, 1981, now U.S. Pat. No. 4,442,973, pertaining to a twist-on fastener.

Various and diverse types of rail fastening assemblies are well known in the prior art. For example, it has become commonplace to secure sections of railway rail to a support (i.e., a sleeper or tie) by means of a generally planar fixture secured to the support by a fastener, with a portion, or extension, of the fixture in contact with the base of the rail. Such clips are commonly termed compression type rail spring clips. Note, for example, U.S. Pat. Nos. 3,206,123, 3,309,023, 3,362,639, 3,378,200, 3,436,018 and 3,477,642, which are exemplary of this class of devices.

Within the recent past, rail clips have been proposed for anchoring rail sections which eliminate the need for a fastener passing directly through the slip or rail-contacting structure itself by employing separate clip and fastener structures. One such class of rail anchoring devices has become known in the art as "Pandrol" clips, which are multi-element clips having a plurality of linear sections joined by convolute sections, whereby the overall profile of the clip may best be described as toric in nature. Along these lines, see, for example, U.S. Pat. Nos. 3,004,716, 3,297,253, 3,427,700, 3,658,246, 3,700,167, and 4,073,435. Numerous other references disclose these or similar railway clips having toric profiles, and having the aforementioned convolute connecting segments between the several linear elements of the clip. Yet another type of rail clip which might be categorized as conceptually similar to the "Pandrol" clips is disclosed in U.S. Pat. No. 4,067,495.

Another variety is that marketed by the Tempered Railway Equipment Co. of Sheffield, England under the name "Springlock". This assembly employs a leaf spring type clip which is restrained in a somewhat horizontal position by an anchoring member, with one end of the clip in engagement with the base flange of the rail, the other end supported by a heel block.

Other efforts directed toward facilitating the anchoring of rail sections to a support include rotatable camming rail clips, such as those disclosed in U.S. Pat. No. 3,018,967 which function in a manner similar to a conventional window latch, being comprised of a base plate having the camming element positioned thereon. When installed proximate the base flange of a rail, the clip may be rotated into engagement therewith.

With respect to rail fastening assemblies of the prior art employing separable rail clips and chairs therefor (the term "chair" is used herein to denote tie securing means adapted to engage the rail clip in secure engagement therewith), the same offer various drawbacks. Although generally effective in terms of their ability to secure the rail to the tie or sleeper, frequently the fabrication and installation thereof are cumbersome and complex. Typically, toric profiles resultant from convolute intermediate sections as related in certain prior art rail clips require considerable forming operations in order to obtain a serviceable device. Likewise, chairs employed in conjunction with this type of clip also requires special casting.

In an effort to overcome these manufacturing problems, U.S. Pat. No. 4,067,495 discloses a spring clip having a pair of distal mounting legs projecting in the same direction and adapted to be seated on opposite sides of the chair and having a crossover loop, the clip being of generally B-shaped configuration. The clip, while relatively simpler to manufacture, requires precise dimensioning and curving of the loop and captured ends.

It is sometimes advantageous to provide a shim or electrical insulator pad between the rail base flange and portion of the clip bearing thereon; as described in U.S. Pat. Nos. 3,460,756 and 3,463,394. In said patented structures, the pads are provided with lateral projections or ears extending from the anchoring element and engaging the outer surfaces of the chair.

In accordance with the deficiencies of prior art rail fastening assemblies, it is a principal object of the present invention to provide a drive-on rail fastening assembly which is of simplified construction, but which operates efficiently under all conditions of use.

Another object of the present invention is to provide a versatile, drive-on rail fastening assembly which may be manufactured and installed in a materially easier manner than prior art rail clips.

Still another object of the present invention is to provide a drive-on rail fastening assembly which eliminates the need to employ any threaded parts.

Yet another object of the present invention is to provide a drive-on rail fastening assembly including a chair which establishes an anchoring-effective torsional force on the generally S-shaped torsional spring rail clip, whereby anchoring efficiency of the assembly is enhanced.

A further object of the present invention is to provide a rail fastening assembly for use in conjunction with concrete ties, where forces exerted on the tie by the assembly are uniformly distributed to improve service life of the tie.

It has now been determined, in accordance with the present invention, that the foregoing objects may be realized by providing a drive-on rail fastening assembly for securing a railway rail to a tie or sleeper therefor, which assembly comprises a generally S-shaped torsional spring rail clip and a cooperating chair adapted to have the clip driven thereon. The rail clip includes a central leg, and a tie anchor portion and a rail bearing portion comprising a pair of loops on opposite sides and extending from opposite ends thereof, each of the loops having an arcuate and a terminal leg. The assembly includes means for establishing a torsional force on the central leg by appropriately tensioning the terminal legs of the loop members.

Yet other objects and advantages of the present invention will become apparent to the skilled artisan upon examination of the following detailed description thereof, taken in conjunction with the figures of drawings, wherein.

Figure 1:
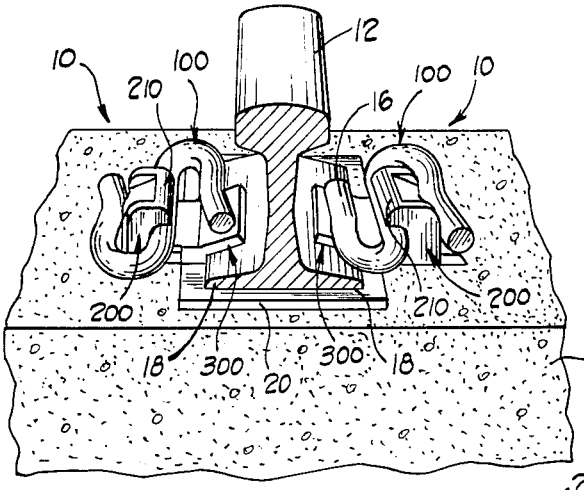
FIG. 1 is an isometric view of a pair of rail fastening assemblies in accordance with the present invention, shown anchoring a railway rail to a concrete support.

The present invention relates to drive-on rail fastening assemblies for securing a railway rail to a tie or sleeper. Rail fastening assemblies are designed to effectively force-couple the railway rail to the tie or sleeper in order to anchor the rail for effective use. In terms of the present invention, this is achieved by embedding the shank of the chair member of the boltless fastener type within the concrete cross tie, securing the rail clip to the chair head disposed above the tie, and securing the clip to the base flange of the rail. Consequently, the rail is force-coupled through the rail clip/chair/tie.

By virtue of this cooperative assembly, complex forces come into play under dynamic conditions in addition to static forces existing between the components, including forces due to expansion and contraction of the rails. The rail fastening assembly must firmly restrain the base of the rail under static conditions and must also operate efficiently under those dynamic conditions which occur during passage of a train along the railway tracks. It is important that the rail fastening assembly maintains positive restraining force on the railway rails under all conditions of use, regardless of longitudinal or wave motion of the railway tracks.

Referring to the figures, in all of which like parts are designated by like reference characters, FIGS. 1–4 show a rail fastening assembly, designated generally as 10, anchoring a section of railway rail 12 to a concrete tie 14. The rail 12, as is conventional, includes a base 16 having laterally projecting flanges 18. A tie pad 20 is interposed between the tie 14 and base 16 of the rail.

The assembly 10 is comprised of a generally S-shaped torsional rail clip, designated generally as 100; a chair, designated generally as 200, adapted to have the clip driven thereon; and a shimming pad designated 300 interposed between the base flange 18 and clip 100. For convenience, that side of the chair 200 facing rail 12 (as viewed in FIG. 2) will be termed the "inner side", while the opposite side will be termed the "outer side". Similarly, that end of the chair 200 from which the clip 100 is driven on (as viewed in FIG. 4) will be termed the "front end", while the opposite end will be termed the "back end".

The rail clip 100 is a torsional spring rail clip having a generally S-shaped geometrical configuration. The simplicity inherent in this design facilitates both the fabrication of the clip as well as application thereof, as described more fully hereinbelow. The clip 100 is comprised of a central leg 102 and a pair of loops 104 and 106 on opposite sides and extending from opposite ends thereof. Loop 104 comprises the tie anchor portion of clip 100, while loop 106 comprises the rail bearing portion thereof, as viewed in FIG. 2. Loop 104 includes an arcuate leg 108 and a terminal leg 110. Similarly, loop 106 includes an arcuate leg 112 and a terminal leg 114. As FIGS. 2 and 4 also show, the length of the central leg 102 is less than the sum of the lengths of the tie loop terminal leg 110 and the rail loop terminal leg 114, and the length of the tie loop terminal leg 110 is less than the length of the rail loop terminal leg 114. Each of the terminal legs 110 and 114 has a free distal end, 116 and 118, respectively. Preferably, the legs have divergent ends and the junctures of terminal legs form protuberant elements 120 and 122.

Figure 12:
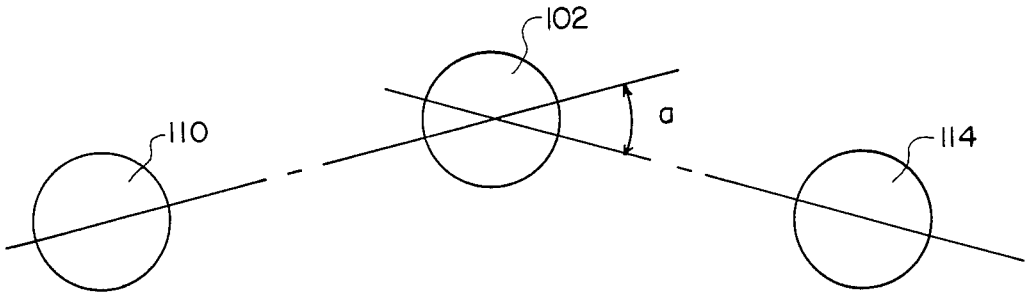
FIG. 12 is a geometric representation of the intersection of a plane, normal to the central leg of a rail clip of the present invention, with the three legs comprising same.

The dimensioning and cross-sectional configurations of the elements comprising rail clip 100 may vary widely without departing from the spirit of the present invention; provided the overall S-shaped geometry is maintained. Accordingly, the central leg and terminal legs might be linear or have a slight curvature imparted thereto. The central axes of each of these members might lie on a common plane or on different planes. For example, the central axes of the central leg 102 and terminal leg 110 might lie on a first plane, while the central axes of the central leg 102 and terminal leg 114 might lie on a second plane, wherein the angular displacement between the two planes may vary up to about 45°, but preferably less than about 15°. FIG. 12 geometrically illustrates this feature of the invention, where the acute angle may vary up to about 45° as aforesaid. In another variation, the three central axes may be skewed with respect to one another. Similarly, the linear distance between successive axes might be the same or different and the relative sizes of the loops 104 and 106 comprising the clip 100 tailored to accommodate the same.

The foregoing variants in geometrical orientations and configurations permit a considerable range of versatility for the S-shaped clip 100; provided overall S-shape is maintained. For example, holding power may be varied as can adaptability for different rail flanges by appropriately altering the geometric angularity and dimensions of the central axes of the elements.

Figure 6:
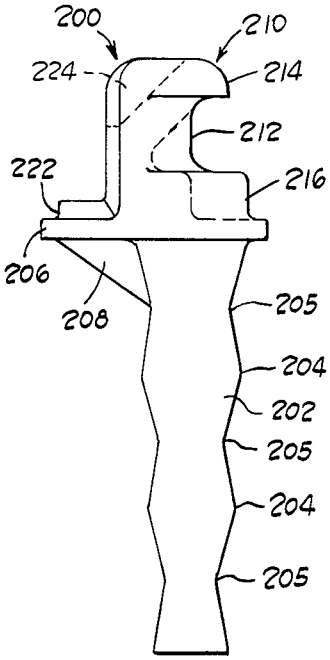
FIG. 6 is a side elevational view of the chair shown in FIG. 5, rotated 90°.

The chair 200 which cooperates with rail clip 100 is comprised of a downwardly projecting shank 202 adapted to be embedded within concrete tie 14. The cross-sectional profile of the shank or stem 202 is preferably rectilinear, preferably rectangular. The outer surface of the shank 202 is shown in FIG. 6 as provided with a stepped wedge configuration resulting from a plurality of laterally projecting ridges 204 which define spaced recesses 205. Accordingly, the shank or stem 202 as shown in said embodiment has a somewhat undulating geometry which materially improves pull-out resistance of the chair 200 from concrete tie 14.

The shank 202 projects downwardly from a shelf 206, which is preferably reinforced at the rear end of chair 200 by a gusset 208 extending between the shelf 206 and the stem 202. Projecting upwardly from the shelf 206 is a head 210.

Head 210 is adapted to receive the tie anchoring portion of rail clip 100, the head cooperating with the loop 104 of clip 100 interiorly thereof to receive the same in latched engagement. The head 210 is formed with a jaw 212 on the inner side thereof; the bight of jaw 212 being provided at its upper end with a projecting lip 214 and at its lower end with a ledge 216 on shelf 206. Preferably, the ledge 216 is comprised of a pair of spaced ledge members. The bight of jaw 212 is configured to receive central leg 102 in close engagement, as best viewed in FIG. 3, and the same are complementary. The head 210 may alternatively be formed with a jaw 212 on the outer side of the chair 200.

A ramp 218 is formed on the shelf 206 on the outer side of head 210. The ramp 218 comprises a sloped leading edge 220 which rises vertically to a flattened, substantially horizontal ledge 222. The terminal leg 110 moves upwardly on the ramp 218 as the clip is driven into its seating engagement with the chair and is lifted thereby.

A latching feature as shown may be provided to firmly secure the clip to the chair head 210. Said latching means comprises a recess 224 formed in the head 210 vertically above the ramp 218 which mates with a protuberance 120 on the side of the terminal leg 110, as best viewed in FIG. 2. The protuberance 120 in such case functions as a detent which snaps into the recess 224 when the clip 100 is driven into engagement with head 210. The recess 224 could, if desired, be provided on the head 210 in another location; or the latching means could consist of a recess in the leg of the rail clip 100, with mating detent means in the chair structure.

Figure 2:
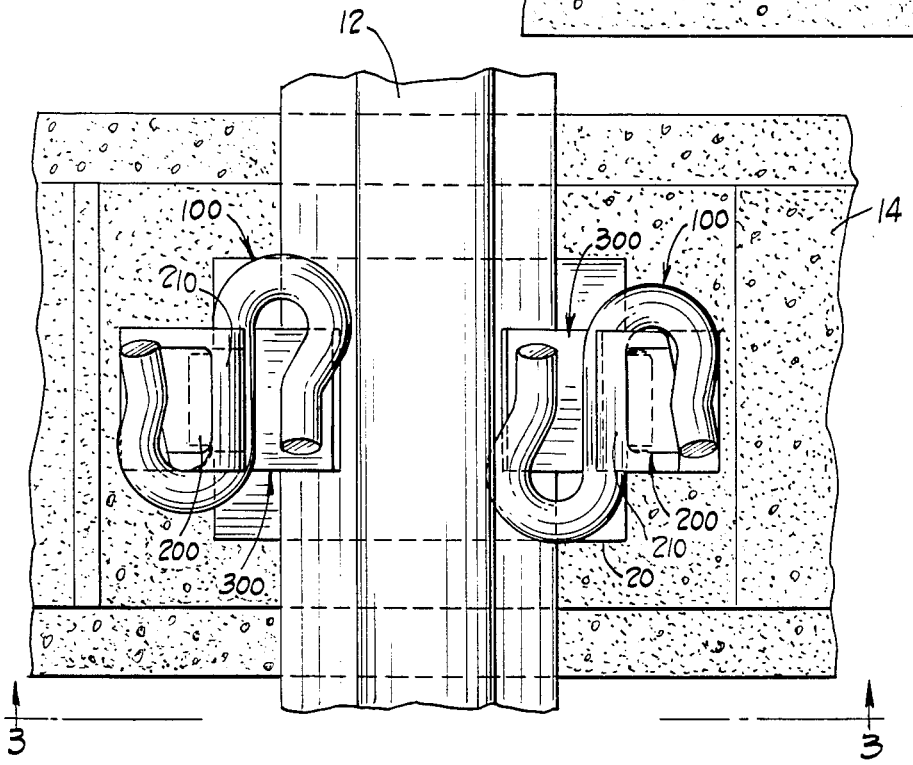
FIG. 2 is a top plan view of the assemblies of FIG. 1.
Figure 7:
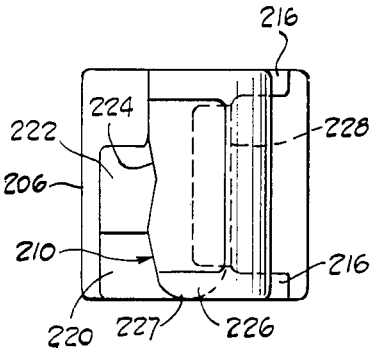
FIG. 7 is a top plan view of the chair shown in FIG. 5.
Figure 8:
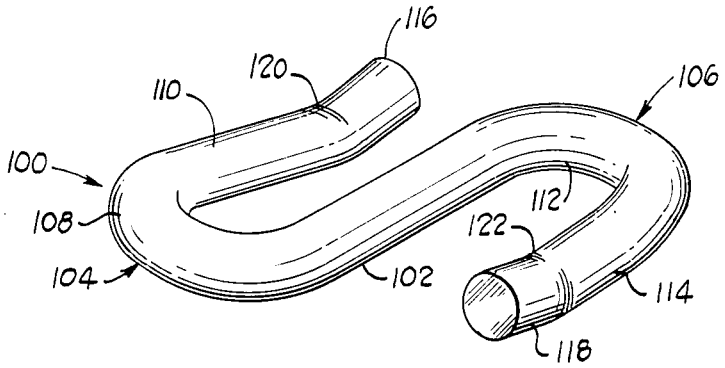
FIG. 8 is an isometric view of a torsional spring rail clip employed in the rail fastening assembly of the present invention.
Figure 9:
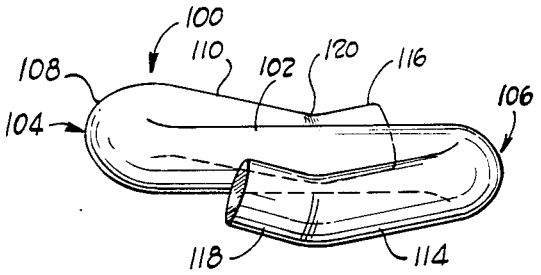
FIG. 9 is a side elevational view of the rail clip of FIG. 8.
Figure 10:
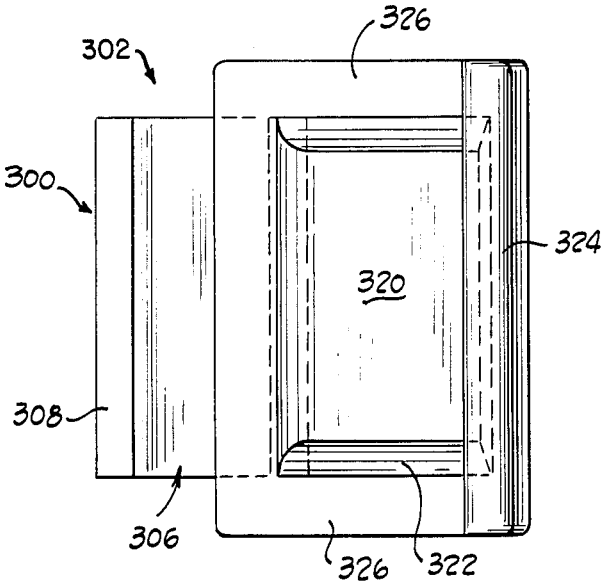
FIG. 10 is a top plan view of an insulator pad employed in the rail fastening assembly of the present invention.
Figure 11:
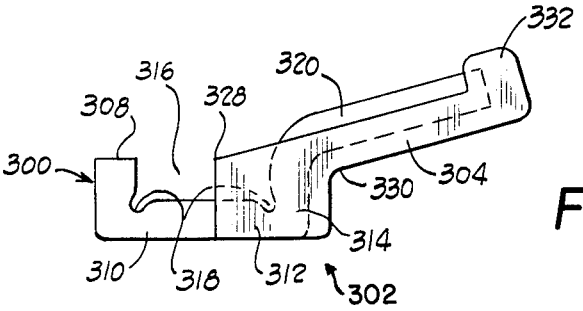
FIG. 11 is a side elevational view of the insulator pad shown in FIG. 10.

The front end of head 200 preferably includes an overdrive protector 226, as best viewed in FIGS. 2 and 7, in the form of an outwardly projecting arcuate face 227. Said overdrive protector 226 insures accurate positioning of the clip 100 on the head 210 during drive-on application of the clip by forming an abutting stop for the arcuate leg 108 comprising the tie anchor portion 104 of the clip. Thus, during application, if this feature is provided, the clip will be limited in its drive-on by abutment of the overdrive protector 226 with the leg 108.

An internal pocket 228 is formed on the inner side of head 210 configured for receiving a projecting central portion of the shim or insulator pad 300, as described hereinbelow. Preferably, the pocket 228 extends between the spaced ledges 216 defining the lower terminus of jaw 212, as described above. Pocket 228 insures accurate placement and alignment of insulator pad 300, while preventing any displacement thereof during dynamic operating conditions which occur as a train passes over the railway tracks. The internal configuration of the pocket 228 and the complementary formation of the pad thus improves the structural integrity of the overall assembly and provides a more efficient cooperation of the elements comprising the same.

A shim or insulator pad preferably is interposed between the top, upwardly sloped face of flange 18 and the rail bearing portion 106 of clip 100. This pad, designated generally as 300, is restrained and positioned by cooperation with internal pocket 228 of chair 200.

A principal purpose of such a pad 300 is for the electrical insulation of the railway rail from those parts securing it to tie 14. The pad must also aid in transmitting an upwardly directed tensional force on terminal leg 114 of clip 100, as described below. Depending upon design requirements for the rail fastening assembly 10, the pad 300 may accomplish either or both of these objectives.

Pad 300 is preferably comprised of a coated metallic shim 302 having a layer of encapsulating, insulation-effective polymer 304 coated thereon in order to afford both a force transmitting structure and one which advantageously electrically insulates the rail and fastening assembly. Pad 300 is susceptible, however, to modification if either feature is not desirable; for example, the polymer coating might be eliminated should electrical isolation of the parts be unnecessary. A highly preferred insulator coating is high density polyethylene; although other similar polymeric materials capable of withstanding the forces to which the insulator pad will be subjected might be selected by the skilled artisan.

The metal shim 302 is comprised of an outwardly projecting center portion 306, which includes an upstanding leg 308 and a lower leg 310 substantially perpendicular thereto. A leg 312 is formed as a continuous extension of the leg 310, and joins an upstanding leg 314 substantially parallel with leg 308. Accordingly, the legs 308, 310, 312 and 314 define a somewhat rectangular channel 316 extending transversely across metal shim 302, the channel having a pair of recesses 318 formed at the bottom corners thereof. A leg 320 extends obliquely from leg 314; the upper longitudinal and transverse edges thereof having a taper 322 and 324, respectively.

Metal shim 302 is preferably encapsulated by the insulation-effective, high density polyethylene material. As shown, the polyethylene coat the edges of legs 312 and 314 to provide an outwardly directed skirt 326 adjacent the tab 306. The tab 306 may thus be inserted within pocket 228 up to the skirt 326. Channel 316 as shown is filled with polyethylene insulator flush with the top surface of leg 308 for the portion of the channel corresponding to leg 310. Beyond that point, denoted 328, the polyethylene surface slopes upwardly corresponding to the upward slope of leg 320. The outer face of leg 314 as well as the bottom face of leg 320 are also provided with a layer of polyethylene 330 which overlaps the top face of leg 320 in the form of a transverse bulbous element 332. Accordingly, the area of contact between the base flange 18 of rail 12 and the rail fastening assembly 10 is effectively electrically insulated, while forces necessary to restrain the rail 12 may nonetheless be effectively transmitted therebetween.

From the foregoing, it is evident that the rail fastening assembly 10 of the present invention enjoys numerous advantages over rail fastening devices known in the prior art. One particularly advantageous feature is the ease with which the respective components may be fabricated.

Fabrication of the S-clip of the present invention is materially simplified over the clips heretofore proposed. For example, standard bar stock of appropriate length and cross-section to form a single clip can be heated and bent around a mandrel in order to achieve the overall S configuration. Subsequently, the detent and required specific angularily between central axes can be imparted to the preformed clip by way of a forging or similar operation. Uniformity of cross-sectional dimensions permits the attainment of uniform metallurgical properties throughout the clip.

Preferably, a mechanical feeder for round stock introduces a piece of steel bar about 1800° F. to a two-stage forming press. The steel, preferably, AISI 1060–1095, is preheated and sized in order that the length of the bar is suitable for yielding a single S-clip. The bar stock is fed to the first stage of the press which imparts the overall S-shape thereto by longitudinally bending the stock about appropriately dimensioned mandrels. Thence, the S-shaped bar is rotated 90° and transferred to the second, final forming stage, where the sides and top geometries are imparted to the clip by a transverse bending operation. Lastly, the formed clip is ejected to a quenching bath and tempered as may be desirable. Because of the uniformity of cross-section, homogeneous metallurgical properties are obtained in the finished clip.

The same may be said with respect to the chair 200, which is preferably cast from malleable cast iron. The lack of through bores or other complex re-entrant design reduces the complexity of the casting process by eliminating cores which must be employed in the casting of known chair designs.

Figure 3:
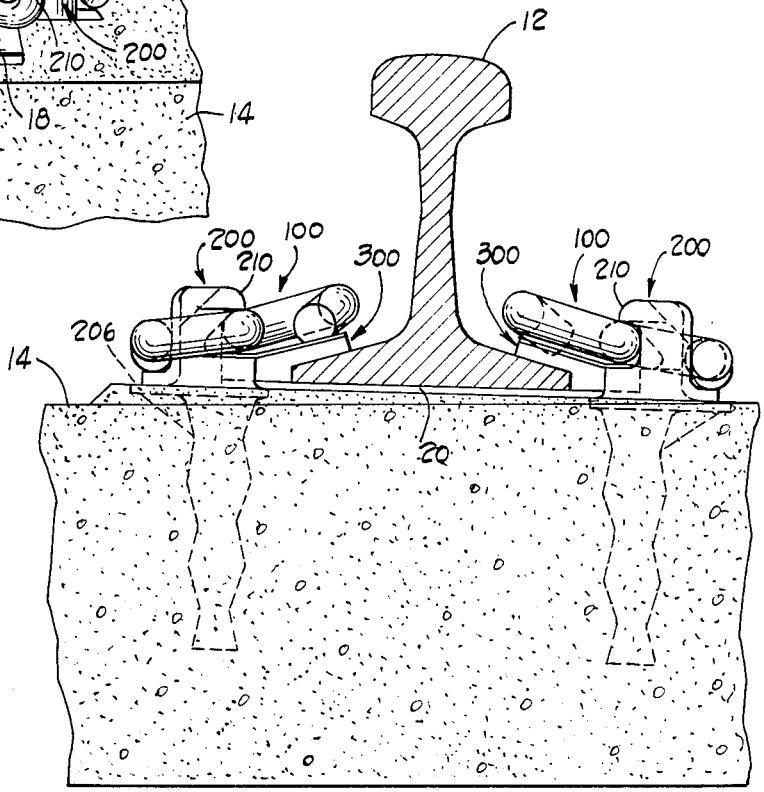
FIG. 3 is an end elevational view along the line 3—3 of FIG. 2.
Figure 4:
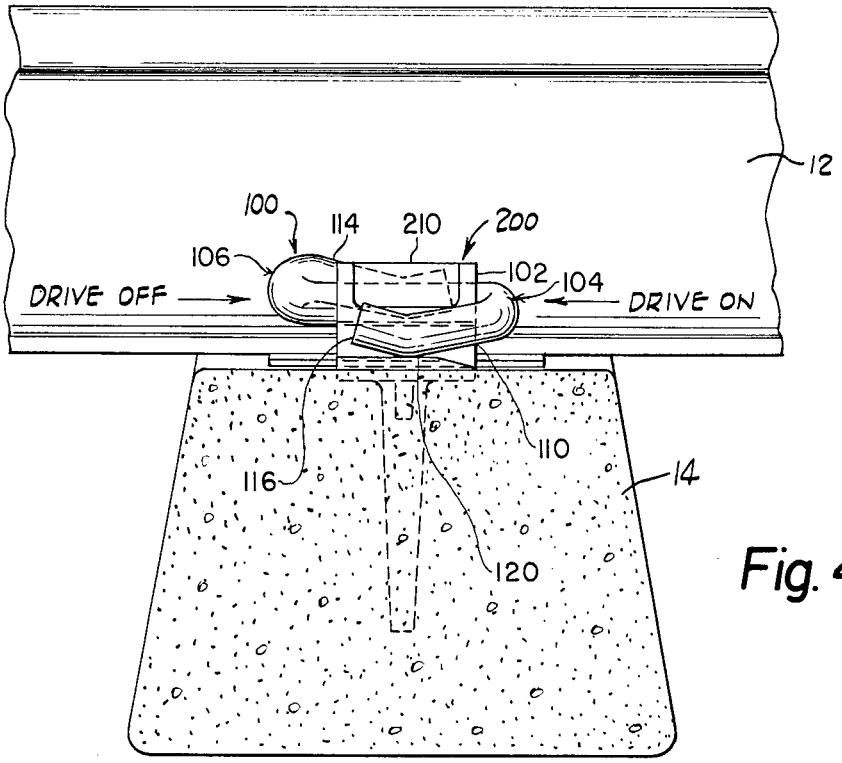
FIG. 4 is a side elevational view of one of the assemblies shown in FIG. 1.
Figure 5:
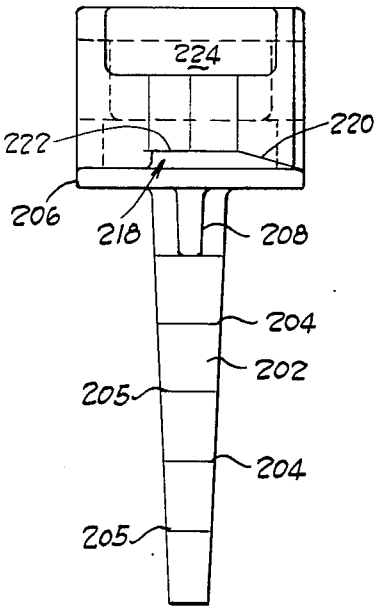
FIG. 5 is a side elevational view of a chair employed in the rail fastening assembly of the present invention.

Once the individual components are fabricated, installation thereof is also quite simple. The chairs 200 may be embedded in a concrete tie prior to a full cure thereof, with the plane of shelf 206 substantially level with the top surface of the tie. As shown in FIGS. 1–3, a pair of chairs will be positioned adjacent to the area of the tie which receives rail 12. When the tie has been positioned, an elastomeric tie pad 20 can then be disposed over the tie and rail 12 positioned between the opposing chairs. Shim or insulator pad 300 is then inserted with lip 306 located in pocket 228 of chair 200. The assembly is completed by driving rail clips 100 into seating engagement with head 210, as illustrated in FIG. 4. Application of the clips 100 may be manual; although automated apparatus for applying the clips is desirably employed.

As the tie anchor portion 104 is driven onto head 210, the tie anchor portion 104 will engage the head 210 and the terminal leg 110 will engage the sloped portion 220 of ramp 218. Simultaneously, the rail bearing portion 106 of the clip 100 will begin riding upon the upwardly sloped face of the flange 18 of the rail. Consequently, as the clip is driven on, upward forces will be exerted on the two terminal legs 110 and 114 and a counter active downwardly directed restraining force will be exerted on the central leg 102. As may be best seen from FIG. 4, the central leg 102 and the tie anchor portion 104 engage the head 210 before these torsional and restraining forces are generated. Thus, an off-center driving force on the tie anchor loop 104 will not drive the distal end 116 of the clip 100 into the chair 200 when the clip 100 is forced into seating engagement. When the clip 100 is fully seated on chair 200, with detent 120 engaging recess 124, the static upwardly directed forces will reach their maximum on these terminal leg members of the clip. The magnitude of these forces can be tailored by appropriate design of the geometrical configuration of the clip structure, taking into account the relative lateral placement of the chair 200 and dimensioning of ramp 218. The projecting lip 214 of jaw 212 will provide a counteractive, downwardly directed restraining force on central leg 102, firmly securing the clip against any longitudinal or rotational displacement. Consequently, the upward force exerted on terminal leg 114 by virtue of the sloping face of flange 18 will be resolved as a counterclockwise torsional force at one end of central leg 102; the force being coupled to the central leg by arcuate leg 112. Similarly, the upward force exerted upon terminal leg 110 by ramp 218 will be resolved into a clockwise torsional force on the other end of central leg 102; the force in leg 110 being transmitted by arcuate leg 108. In this manner, both ends of central member 102 are wound up yielding a torsional spring clip.

Due to the manner in which the torsional forces are applied to central leg 102, the rail fastening assembly 10 provides a positive downward restraining force on the flange 18. Any motion of the rail, whether it be longitudinal or transverse (including any wave or rocking motion) will not diminish the efficiency of the rail fastening assembly, and that rail motion will be positively counteracted by the downward force on the base flange. Consequently, the rail is efficiently force coupled to the tie or sleeper.

Moreover, the forces (whether static or dynamic) are efficiently distributed by virtue of the rail fastening assembly 10. This is a very important consideration when concrete ties are employed since any stress concentration between the fastening assembly and the tie contributes to enhanced degradation and/or premature failure of the latter. Conversely, uniform force distribution such as that provided by the present invention materially increases the life expectancy of these concrete ties.

While the invention has now been described with reference to certain preferred embodiments, the skilled artisan will recognize that various substitutions, modifications, changes and omissions may be made without departing from the spirit thereof. Accordingly, it is intended that the scope of the present invention be limited solely by that of the appended claims.

What I claim is:

1. A drive-on rail fastening assembly for securing a railway rail, having laterally projecting base flanges, to a support therefor, said assembly comprising:

(a) a generally S-shaped torsional spring rail clip including a singular generally linear central leg, a tie loop having an arcuate portion extending from a first end of said central leg to a terminal leg having a free distal end, and a rail loop having an arcuate portion extending from the second end of said central leg to a terminal leg having a free distal end, said central leg having a length which is less than the sum of the lengths of said tie loop terminal leg and said rail loop terminal leg, said tie loop terminal leg having a length which is less than the length of said rail loop terminal leg; and (b) a chair positioned adjacent a railway rail, said chair having (i) anchoring means for securing said chair to said support for said rail, (ii) a front end and a back end (where said rail clip is driven onto said rail and chair from said front end toward said back end) with a tie side and a rail side extending between said ends, (iii) a head means extending from said front end of said chair toward said back end, said head means having a jaw means facing toward one of said sides of said chair for receiving at least a portion of said central leg when said rail loop terminal leg engages said rail base flange and said tie loop terminal leg engages said chair, (iv) a ramp means disposed on said tie side of said head means for engaging said tie loop terminal leg when said clip is placed on said rail and said chair and then driven into position, said ramp means rising from said front end of said chair to a point disposed behind the front-most end of said head means, at which point said ramp first exerts an upwardly directed force on said tie loop terminal leg urging said central leg against said jaw means whereby said head means is disposed between said central leg and the distal end of one of said terminal legs of said rail clip before said central leg is urged against said jaw means.

2. The assembly of claim 1, wherein said head means projects through the tie loop.

3. The assembly of claim 2, wherein said head means is engaged with both of said central leg and tie loop.

4. The assembly of claim 1, wherein a plane normal to said central leg and passing through said clip has three points thereon corresponding to the intersection thereof with the axes of the central leg and terminal legs of said clip, the points on said plane corresponding to the axes for said central leg and a first of said terminal legs defining a first line and the points on said plane corresponding to the axes for said central leg and the second of said terminal legs defining a second line, the acute angle between the intersection of said first and second lines being less than about 45°.

5. The assembly of claim 4, wherein said acute angle is less than 15°.

6. The assembly of claim 4, wherein at least two of said axes are skew with respect to one another.

7. The assembly of claim 4, wherein the three axes are skew with respect to one another.

8. The assembly of claim 4, wherein said clip is fabricated from a unitary piece of spring steel.

9. The rail fastening assembly of claim 1, wherein each of said distal portions of said clip includes a terminal leg, at least one of which terminates in an upwardly divergent end.

10. The rail fastening assembly of claim 1, further comprising shim means interposed between the distal portion of the rail loop and said base flange.

11. The rail fastening assembly of claim 10, wherein said shim is an electrical insulator.

12. The rail fastening assembly of claim 11, wherein said head means includes a pocket for receiving one end of said shim and positioning the other end thereof between said rail loop and said base flange.

13. The rail fastening assembly of claim 1, wherein said ramp means comprises a ledge on said head beneath the terminal leg of the tie anchor portion of said rail clip.

14. The rail fastening assembly of claim 13, wherein said ramp means includes a sloped ramp face.

15. The rail fastening assembly of claim 1 comprising a protuberance on the loop portion of the clip engaging said head means and said head means comprises a recess for mating engagement therewith, said protuberance functioning as a detent which snaps into said recess when said clip is driven into engagement with said head.

16. The rail fastening assembly of claim 1, wherein said anchoring means comprises a shank projecting downwardly from said head means.

17. The rail fastening assembly of claim 16, wherein said shank is a rectilinear shank with a stepped wedge outer surface.

18. The rail fastening assembly of claim 17, wherein said shank is embedded in said support.

19. The rail fastening assembly of claim 18, wherein said support is a concrete tie.

* * * * *

UNITED STATES PATENT AND TRADEMARK OFFICE

CERTIFICATE OF CORRECTION

PATENT NO. : 4,715,534

DATED : December 29, 1987

INVENTOR(S) : Graham M. Fee

It is certified that error appears in the above-identified patent and that said Letters Patent is hereby corrected as shown below:

Column 1, line 10, "patent" should be --present--.

Column 7, line 56, "124" should be --224--.

Signed and Sealed this

Twenty-ninth Day of November, 1988

*Attest:*

DONALD J. QUIGG

*Attesting Officer*

*Commissioner of Patents and Trademarks*